US005466192A

United States Patent [19]

Castolo et al.

[11] Patent Number: 5,466,192

[45] Date of Patent: Nov. 14, 1995

[54] ADJUSTABLE HINGED BOWLING WRIST SUPPORT

[76] Inventors: Rodrigo L. Castolo; Thomas S. Castillo, both of 707 Continental Cir. #212, Mountain View, Calif. 94040

[21] Appl. No.: 165,019

[22] Filed: Mar. 3, 1994

[51] Int. Cl.[6] ..... A63B 69/00; A61F 5/04

[52] U.S. Cl. ..... 473/62; 473/61; 2/162; 2/161.1; 482/45; 602/16; 602/21

[58] Field of Search ..... 473/59, 61, 62, 473/63; 482/44, 45, 46, 47, 49, 50; 2/16, 20, 159, 160, 161.1, 162, 163, 170; 602/5, 16, 21

[56] References Cited

U.S. PATENT DOCUMENTS

| | | | |
|---|---|---|---|
| 3,606,342 | 6/1969 | Albertson, Jr. | 473/62 |
| 3,707,963 | 1/1973 | Keropian | 602/21 |
| 4,608,720 | 9/1986 | Purin | 473/61 |
| 4,618,147 | 10/1986 | Hurd et al. | 473/62 |
| 4,660,550 | 4/1987 | Bodine | 602/16 |
| 4,666,158 | 5/1987 | Moro | 473/62 |
| 5,163,678 | 11/1992 | Rogers | 473/62 |
| 5,254,078 | 10/1993 | Carter et al. | 602/21 |

*Primary Examiner*—Vincent Millin

*Assistant Examiner*—William M. Pierce

[57] ABSTRACT

It's a movable bowling wrist device that is secured to the back of the hand and forearm by means of straps and it consists of four main structural parts made of stainless steel. The hand portion with all its finger extensions and forearm portion are connected together by a wing type structure with an attachment of an adjustable stopping mechanism on top. The hand portion with all its finger extensions is indefinitely moving vertically perpendicular to the wing part from which it is connected can be indefinitely adjusted from left to right or vice versa on a horizontal plane on which it is attach to the forearm portion can be place in a locking position by a swiveling lock. The adjustable stopping mechanism stops the hand portion with all its finger extensions on a backward movement thus producing an angle perpendicular to the forearm portion. Thus the angle formed is not constant, it is merely restricted or limited in a position by the backward movement of the hand portion with all its finger extensions, an indefinite forward motion of the hand will automatically unrestrict the restricted angle formed and a greater angle will be taken into action. And the indefinite foward motion of the hand portion with all its finger extensions, can help the bowler cupp and uncupp, push to create additional or lesser rotation and revolution, from the restricted angle produced, to the ball freely without limitations during delivery and point of release.

8 Claims, 12 Drawing Sheets

P4

ADJUSTABLE HINGED BOWLING WRIST SUPPORT

BACKGROUND OF THE INVENTION

This device is basically use in the sport of Bowling. A bowler must have a firm wrist, hand and a consistent natural follow through at different positions, to achieve good scores. To be able to attain a firm wrist and hand, lots of practice is needed to develop the necessary muscles that pertains to the sport. A good wrist device may or may not be needed by a bowler to gain a good shot at the point of release. To be able to bowl good, a bowler must adjust to different lane condition of bowling centers. There are lanes that are oily, medium oil, spotted, reverse, dry, etc. To attain it, a bowler must cupp or uncupp, position it sideways from left to right or vice versa his hand and wrist or do both things to attain the shot needed by the bowler that corresponds to the lane condition.

There are a lot of bowling wrist devices developed that were successful, a number of them such as U.S. Pat. No. 4,371,163 limits the movement of the forefinger, hand and wrist, U.S. Pat. No. 5,163,678 allows the movement of the back up member of the hand and forefinger that is pivotally connected to the backup member of the forearm and be fixed to an angle or to another of the foward and backward motion of the hand backup member and can be secured by means of 62 and 64 as shown in FIG. 3 and 4 of the patented art. U.S. Pat. No. 4,666,158 describes that his device particularly the pivoting pads 59 of the hand unit can be adjusted from left to right or vice versa as shown in FIG. 6 and 7, be secured or locked by predetermined holes by the use of 82 and 80 and the angle of the hand unit can be adjusted on a fixed position by pivoting 69 from the arm unit as shown in FIG. 4 and 5, be secured by means of predetermined holes using 61 and 76 on a foward and backward movement. But all of this might have been a notable setback because the indefinite forward follow through movement of the hand unit at the point of release is restricted at an angle and thus prevents the natural feel of a foward movement of the hand as the ball is being release at the end of the approach of the bowling lane. Experts in the field of Bowling advices that it's better to bowl with bare hands so that you can feel and do anything with the ball at the release, but sadly to say that not everyone of us can attain to do it. So, a wrist support is needed. But too much limitations and restrictions may also cause problems, that's why a proper wrist support device is needed which can point out the intended restrictions and still achieve a natural feel like bowling with your bare hands.

SUMMARY OF THE INVENTION

The primary intention of the prior invention is to support the wrist and hand with all its finger extensions with a natural feel, it's like not using a wrist device at all. Because the device is movable and the bowler can choose either one limitation or restriction or all its restrictions or none at all. To be able to choose a desired limitation or limitations, the bowler is in control of the device which in return can give a natural movement of the wrist and hand and not vice versa.

Another intention of the invention is that this device has the unlimited adjustment of the breaking backward motion of the hand back up member and all its finger extensions, an adjustable stopping mechanism is use to prevent the backward movement. By this action, a desired angle is produced by the bowler. Thus the angle produced is not limited and restricted on a foward motion, it is merely restricted furthermore from breaking backwards at an adjusted, limited angle. So this statement illustrates the hand back up member is perpendicularly moving from the wing part from which it is connected and attach to the arm back up member. This device gives the bowler unlimited combination of adjustments that will respond to the condition of the bowlers expectation.

It is a further intention of this wrist device is to produce an indefinite forward movement of the hand back up portion and hand back up portion with all its finger extensions or support. Thus having a foward motion, the hand back up portion support as presented in FIG. IVb P1, the extended forefinger support as presented in FIG. **1*a* P1, the extended forefinger with middle and ring finger support as presented in FIG. Va P1, the extended middle and ring finger support as presented in FIG. IVa P1, the extended small finger support as presented in FIG. Vb P1**, can be limited in the backward motion by means of an adjustable stopping mechanism, a desired angle is then produced and it is not constant because of the indefinite forward motion. By this explanation, the indefinite foward motion that started in the desired angle that was produce an enormous push can be exerted by the hand back up portion with or without the finger extensions during delivery and point of release of the ball as it is being thrown down the lane. On this statements, additional power, rotation and revolution is added or neglected if the angled produce is at the backward end of the adjusted limitation, to the ball. Another object of the foward motion of the hand unit, is provides a natural follow through of the hand, while if the hand unit or back up member is restricted in a constant angle, the flexibility of the wrist in a foward motion is restrain, thus producing the inability of the natural foward movement or follow through of the whole arm and hand.

Another object of the invention is that, the hand back up portion with or without the finger extensions while moving indefinitely of a perpendicular positioned plane from the wing part from which it is connected, can be adjusted indefinitely on a sideway movement, as shown in FIG. Ia P2, and FIG. Ib, off which the wing part is attach on the same plane of the arm back up portion. It can be secured or not by a swivel lock as presented in FIG. Ib, in a desired angle or moving from side to side respectively.

The intention of the invention also is to show that, the clockwise movement of the adjustable stopping mechanism, which involves the adjustable screw, creates a foward angle that produces more revolution and rotation when the hand back up member with all its finger extensions, touches the adjustable stopping mechanism on a backward motion, while on a counter clockwise movement of the adjustable screw, creates a lesser or negative angle that produces lesser ball rotation and revolution.

BRIEF DESCRIPTION OF THE DRAWINGS

WRISTEC MODEL SC I (FIG. Ia) This device shows a hand back up portion with a wide irregularly shaped pointing finger P1, a wing type part P2 connected to the hand back up portion, a forearm back up portion P3, an adjustable stopping mechanism P4 which is attached to the wing part.

WRISTEC MODEL SC II (FIG. IVa) This device shows a hand back up portion with a middle and ring finger extension P1, a wing type part P2 connected to the hand back up portion, a forearm back up portion P3, an adjsutable stopping mechanism P4 which is attached to the wing part.

WRISTEC MODEL SC III (FIG. IVb) This device shows a hand back up portion wherein the support extends only up to the knuckles P1, a wing type part P2 connected to the hand back up portion, a forearm back up portion P3, an adjustable stopping mechanism P4 which is attached to the wing part.

WRISTEC MODEL SC IV (FIG. Va) This device shows a hand back up portion with a wide irregularly shaped pointing finger and with a middle and ring finger extension P1, a wing type part P2 connected to the hand back up portion, a forearm back up portion P3, an adjustable stopping mechanism P4 which is attached to the wing part.

WRISTEC MODEL SC V (FIG. Vb) This device shows a hand back up portion with a wide irregularly shaped small finger extension P1, a wing type part P2 connected to the hand back up portion, a forearm back up portion P3, an adjustable stopping mechanism P4 which is attached to the wing part.

FIG. Ib - This device shows the indefinite movement of the hand back up portion with a wide irregularly shaped pointing finger extension connected to the wing type part moves from left to right and vice versa, a swivel lock can be use to lock or secure the sideway movement. The same action is also true for all the stated models above.

FIGS. IIa and IIb - This device shows the side elevation. The hand back up portion with a wide irregularly shaped pointing finger moves freely on a indefinite plane on a backward and foward movement while it is connected to the wing type part. The same action is also true for all the stated models above.

FIG. IIIa - Shows the invention placed on top of the back of the forefinger, hand, wrist and forearm. The hand back up portion with a wide irregularly shaped pointing finger was secured to the back of the hand by means of a strap that goes around the hand. A strap is also used to secure the forearm back up portion to the back of the forearm by wrapping the strap around the forearm near the wrist area. It is slip into a strap holder on the inside part and goes out. The holder is attached to the side of the forearm back up portion and secure it by wrapping it around the forearm again. Velcro is use to secure or hold the position of the straps. The same action is also true to the models stated above.

FIG. IIIb - Shows a detailed description of an adjustable stopping mechanism.

FIG. IIc - Shows the back side elevation of the invention.

DESCRIPTION OF THE PREFERRED EMBODIMENTS

Complying to FIGS. I to V, generally illustrates and describes the movable bowling wrist device. The prior invention is use primarily for the support of the fingers, hand and wrist while holding or carrying the bowling bowl during delivery and point of release and the prior invention goes with a right and left version. It is made up of a compilation of stainless steel, bolts, nuts, foam rubber paddings, leather and nylon straps.

Figure 1A:
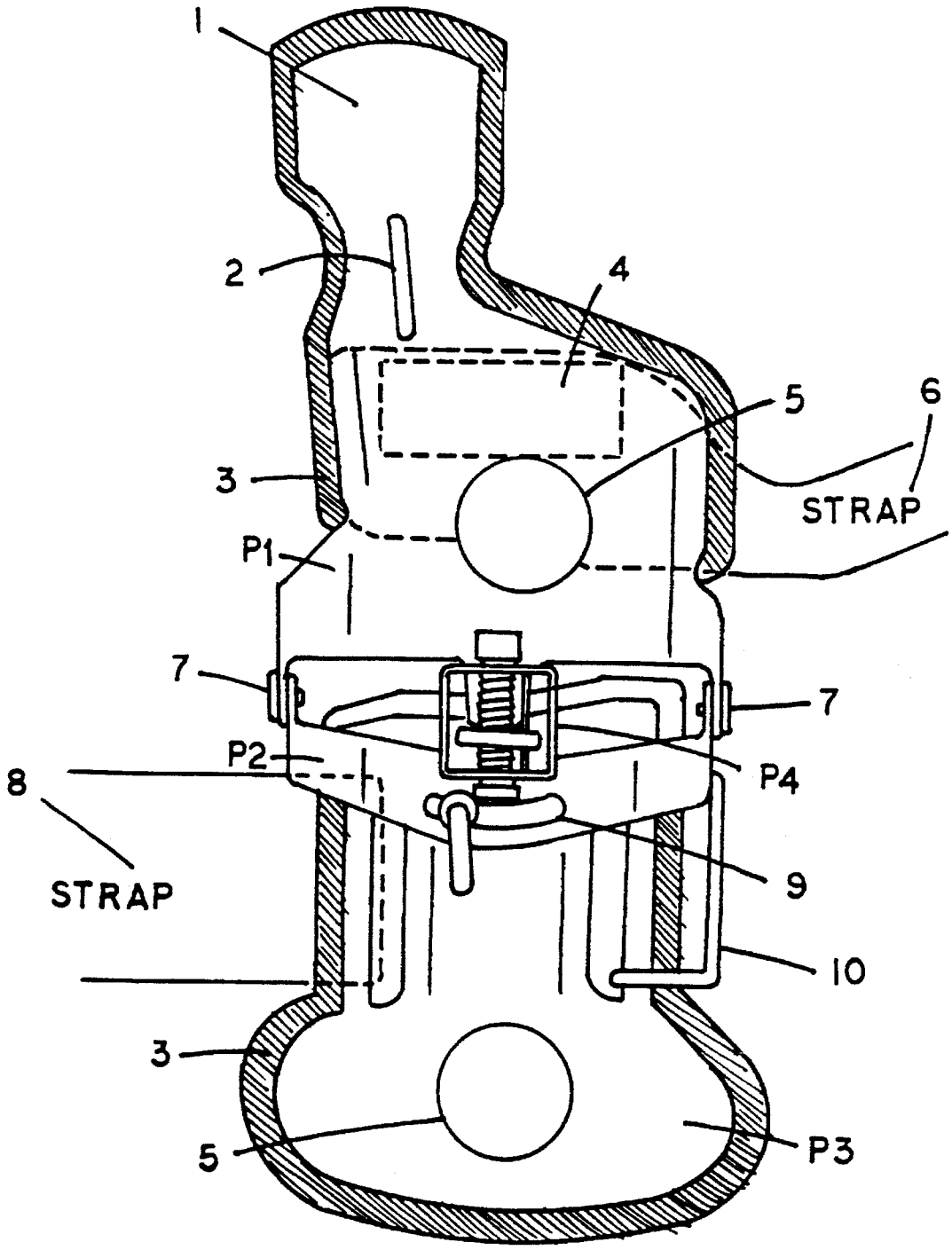
Figure 1B:
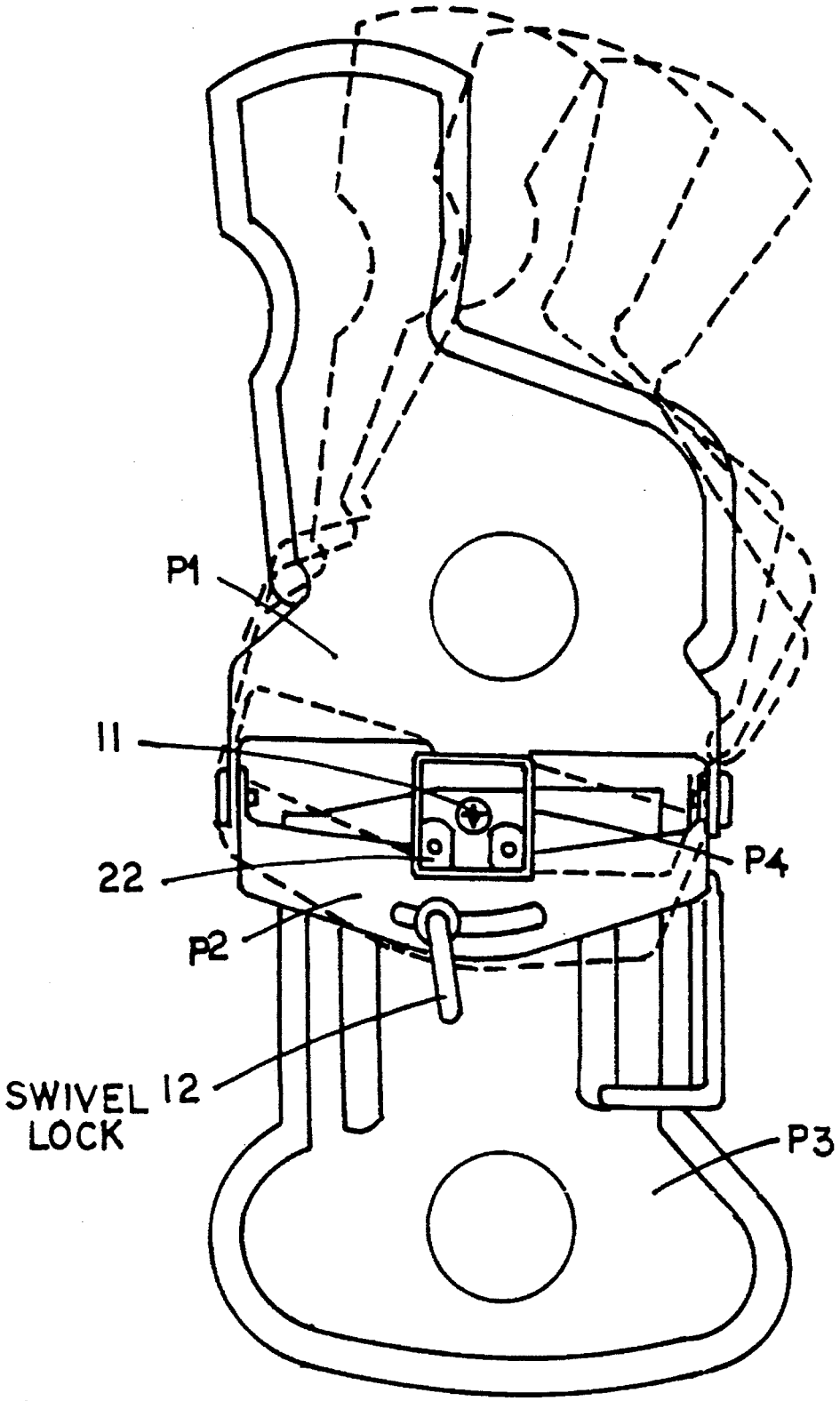
Figure 1C:
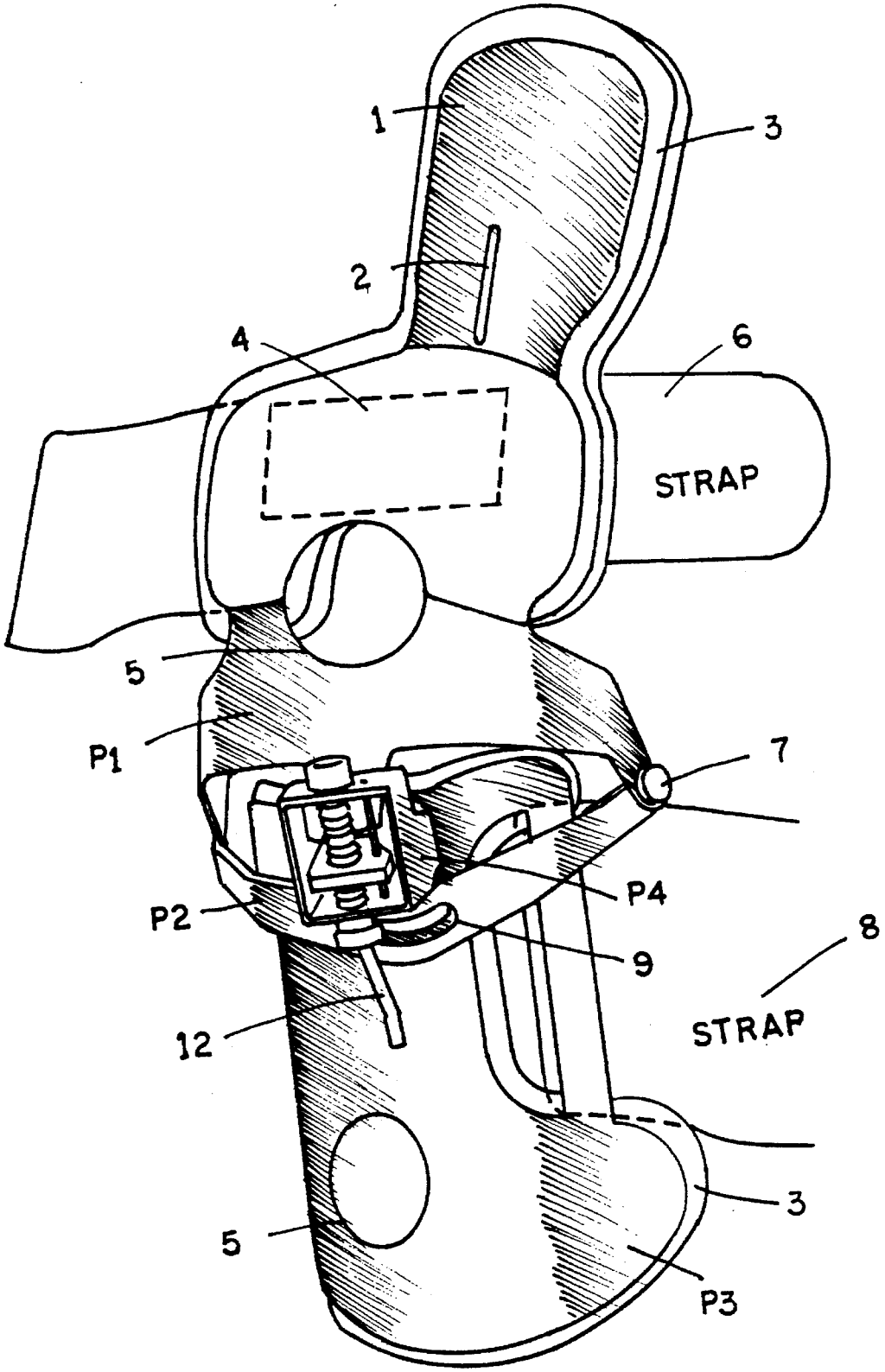
Figure 2A:
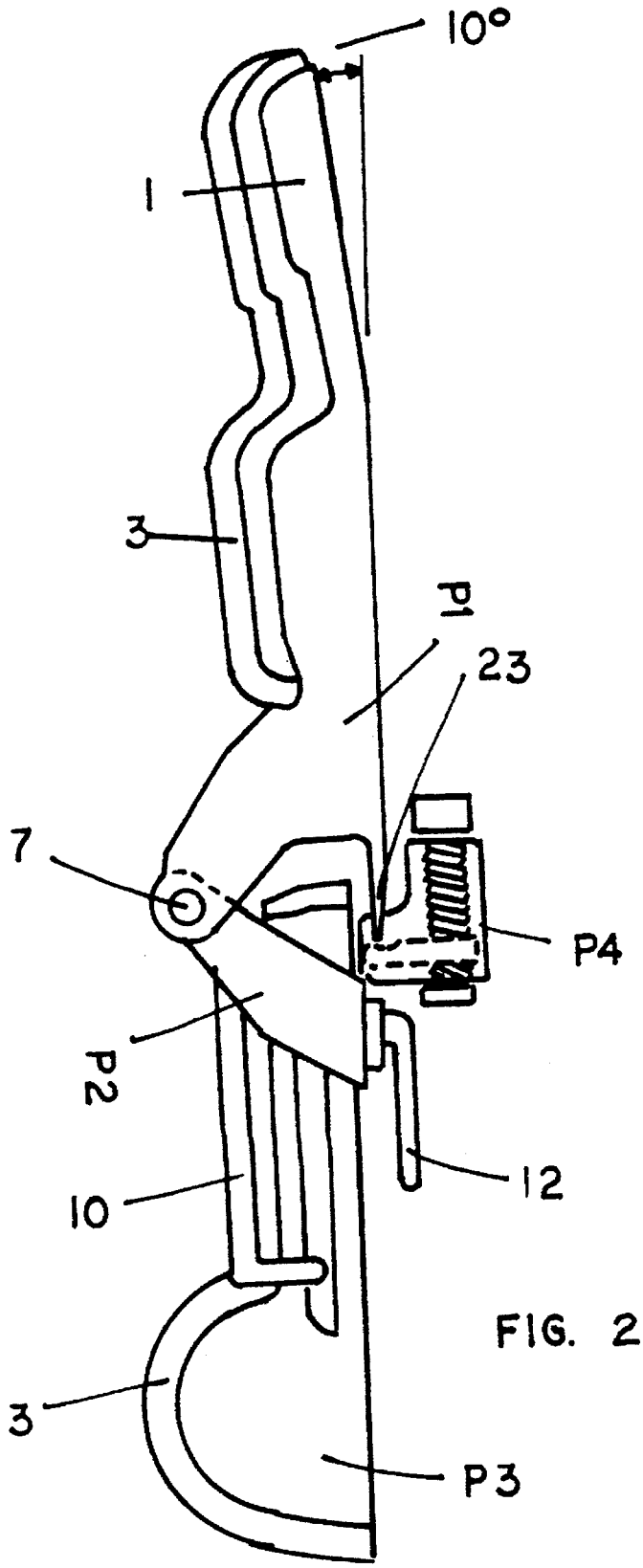
Figure 2B:
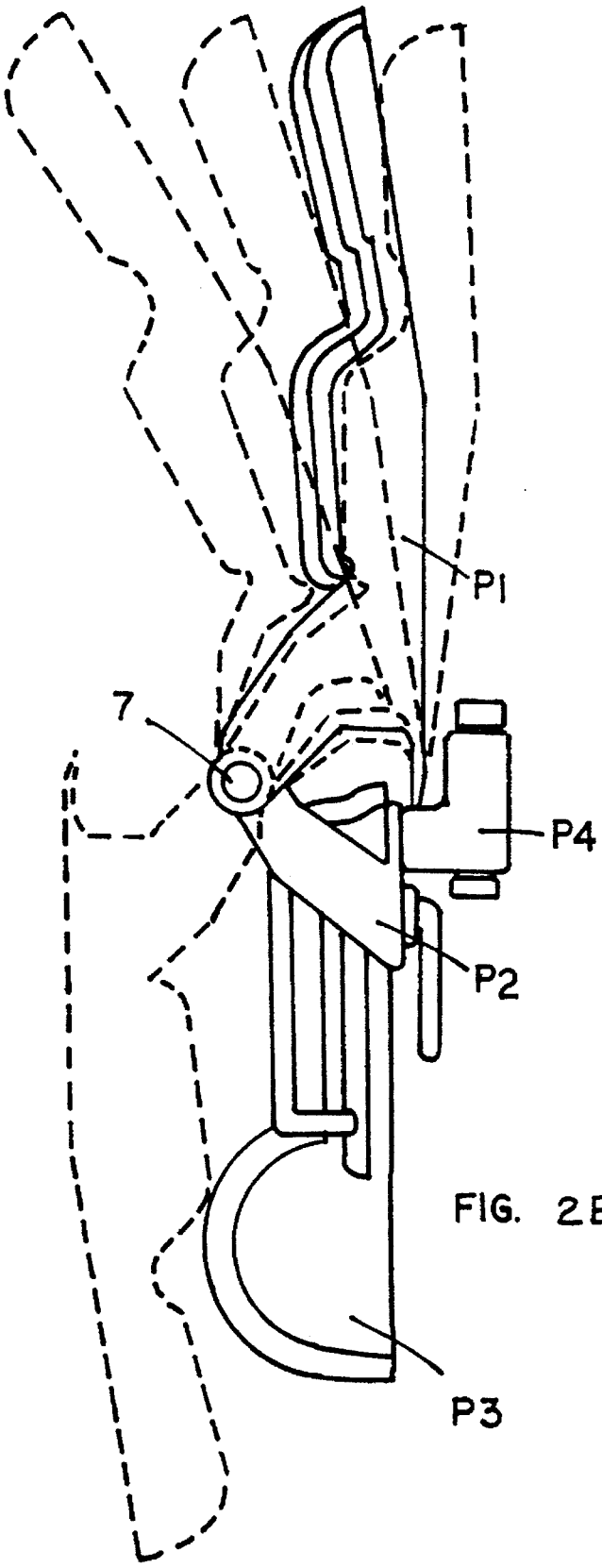
Figure 2C:
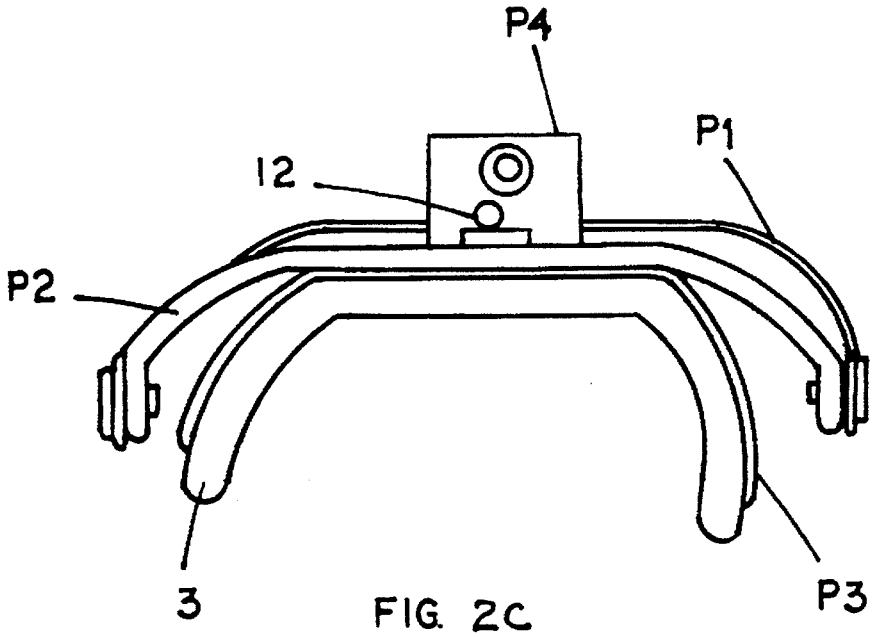
Figure 3A:
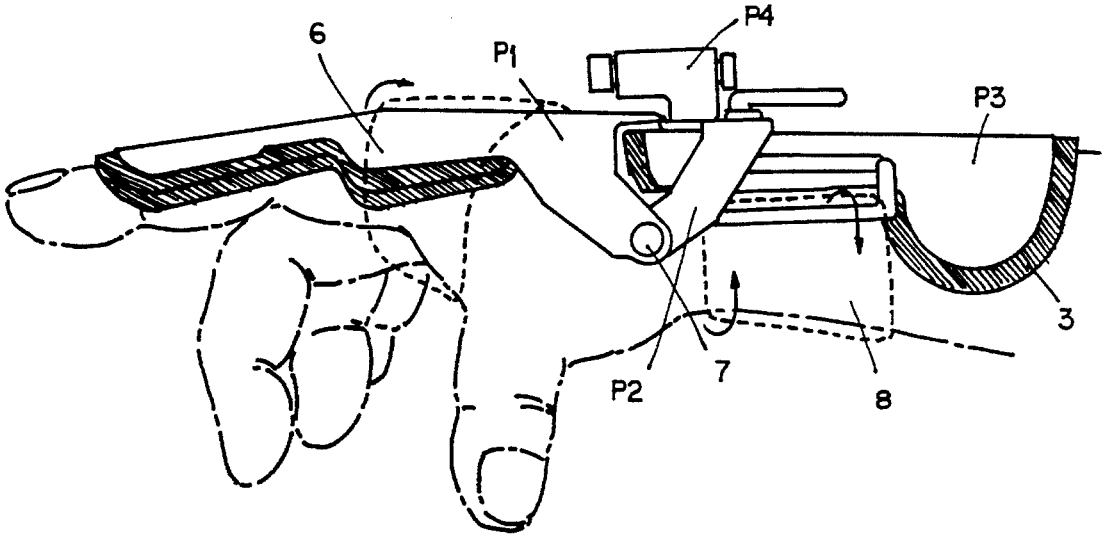
Figure 3B:
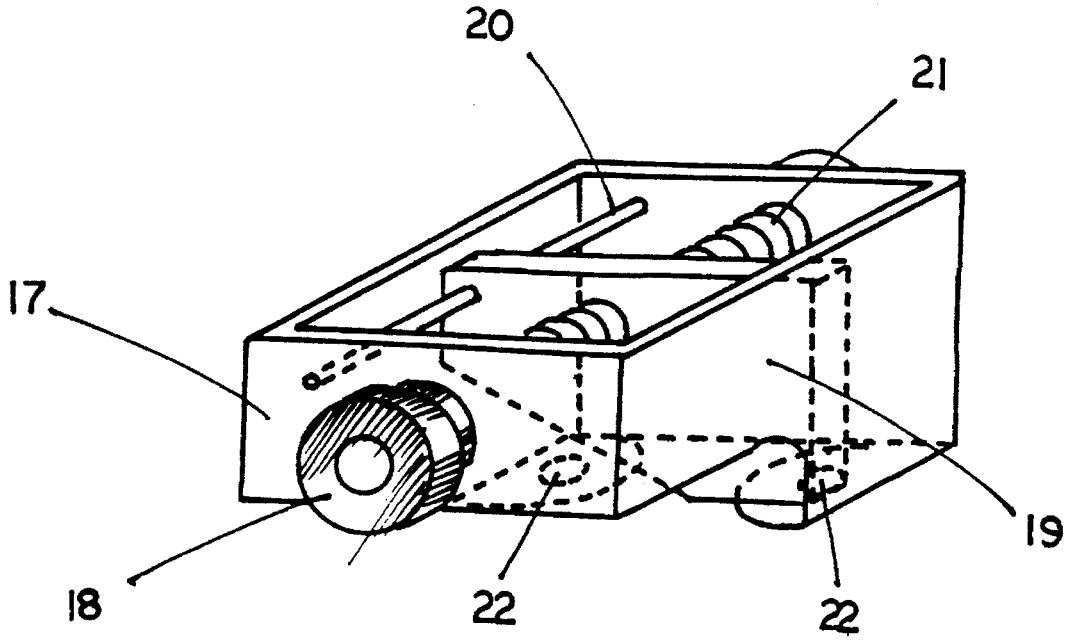
Figure 4A:
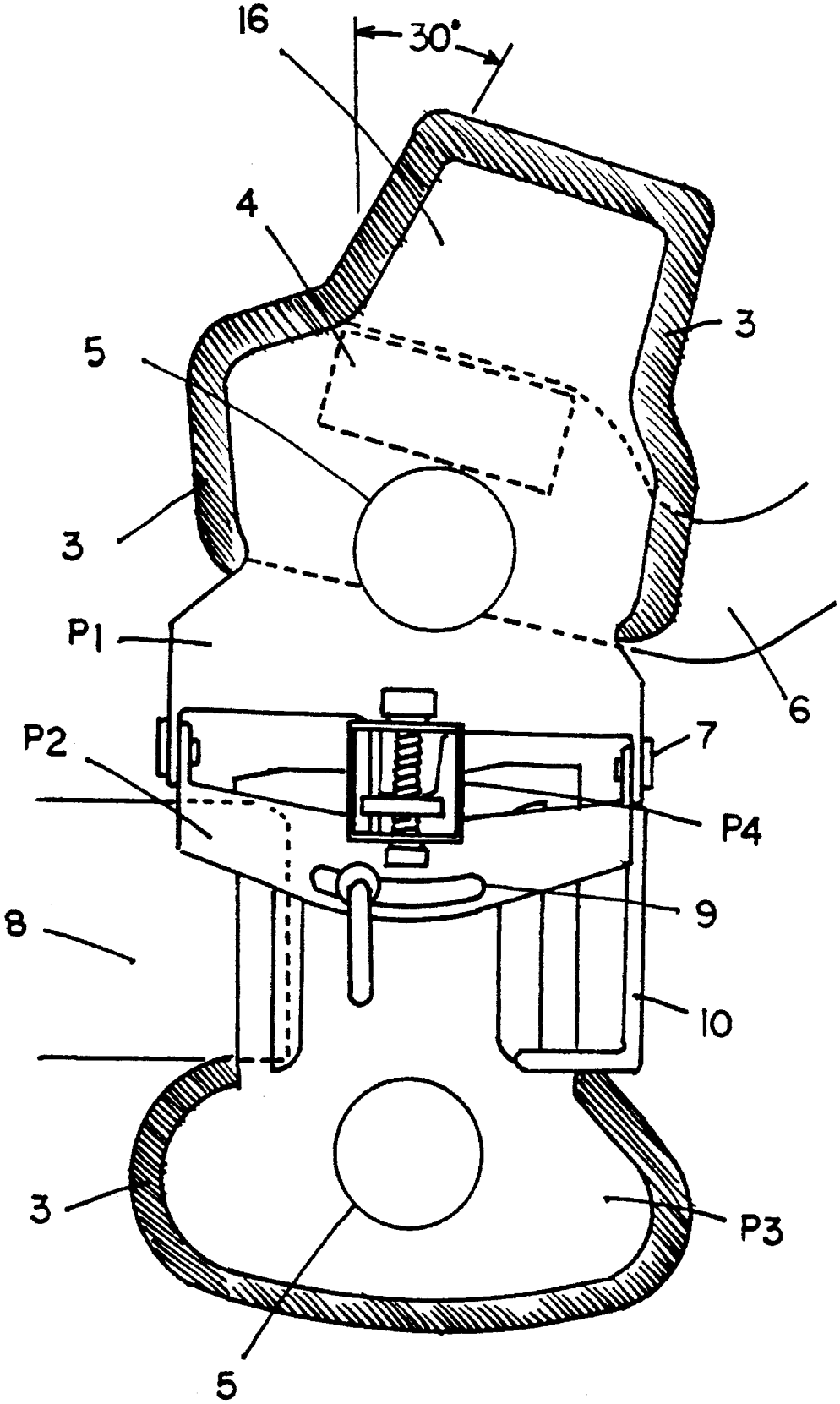
Figure 4B:
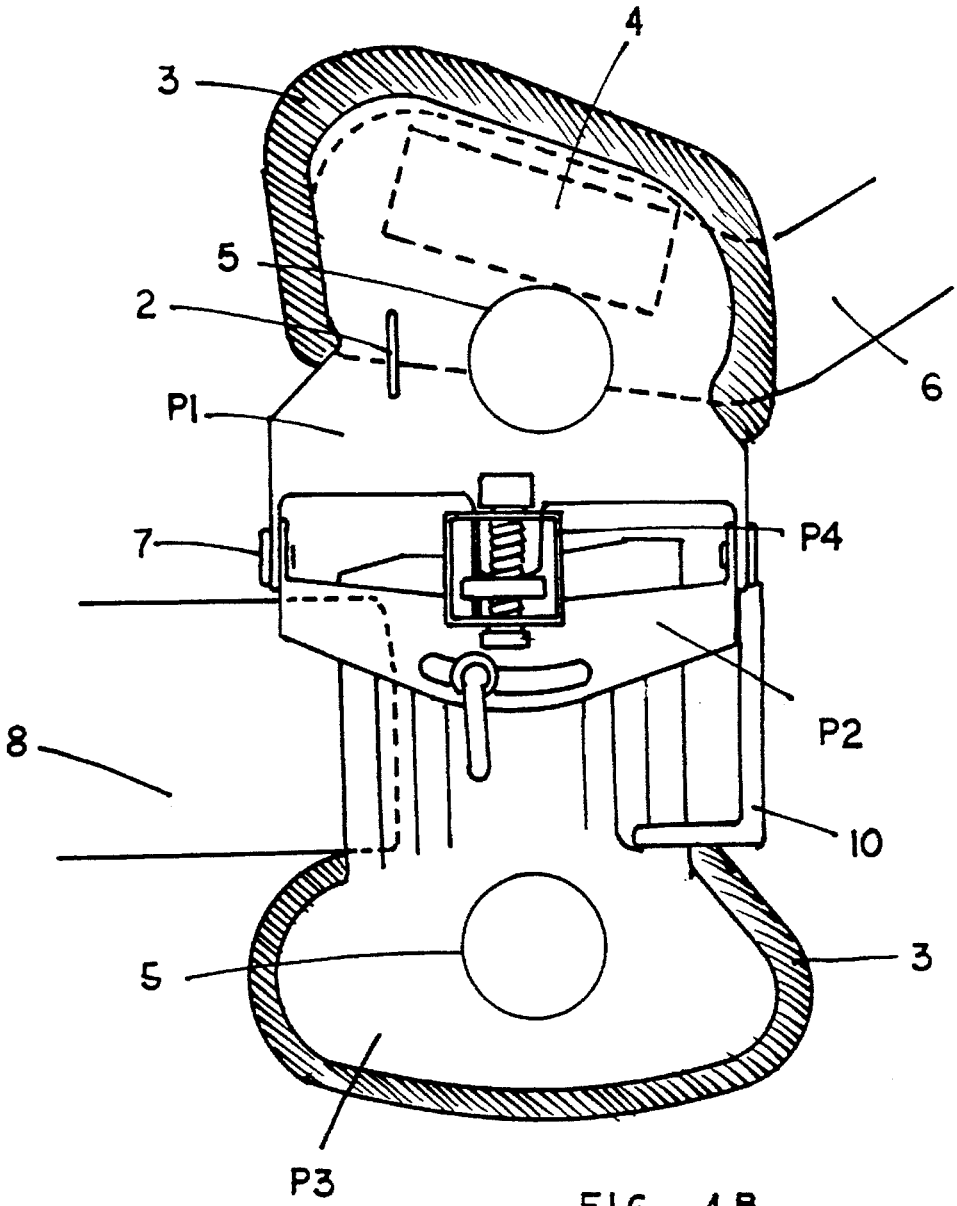
Figure 5A:
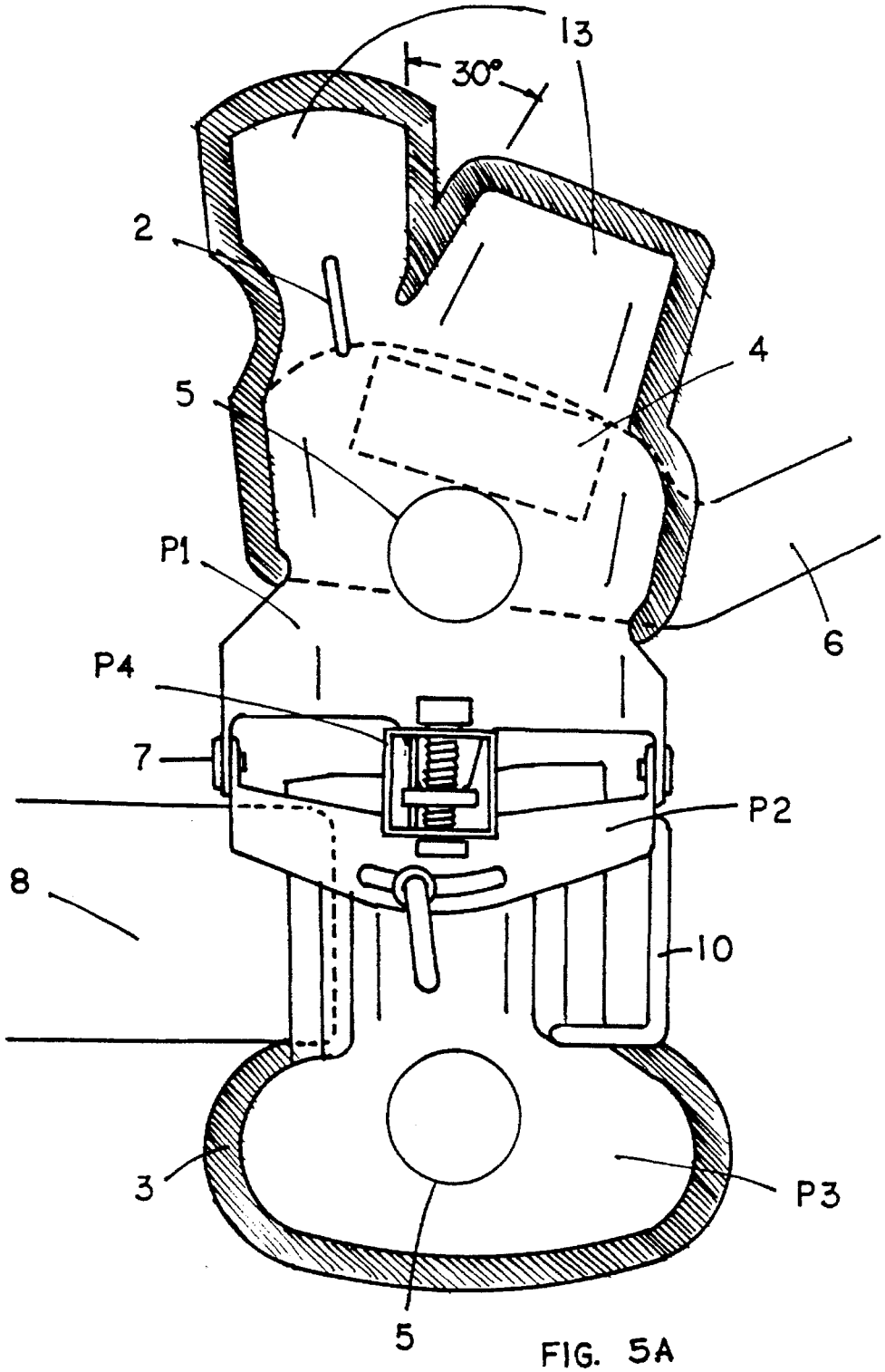
Figure 5B:
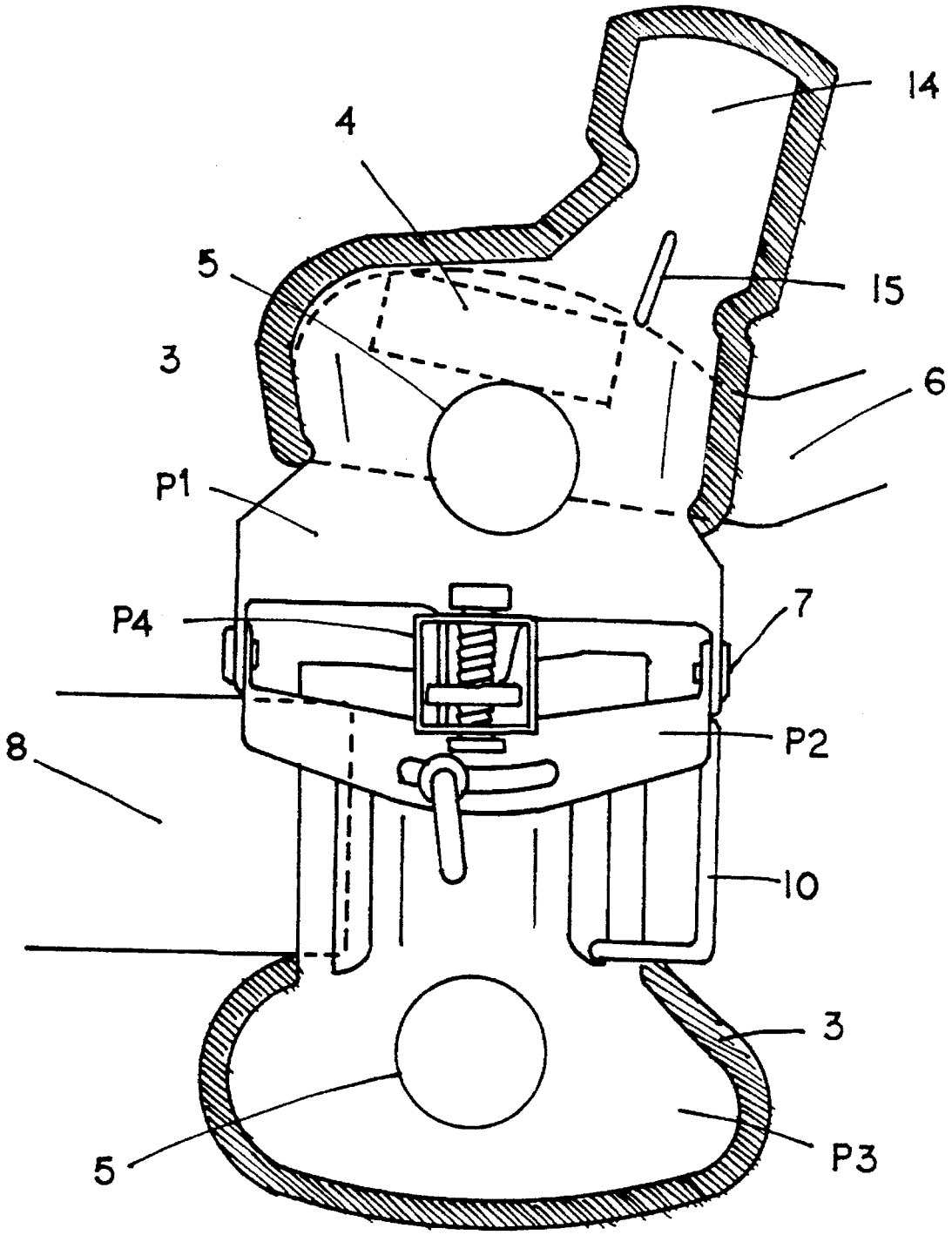

The hand back up portion with all its finger extensions P1 as shown in FIGS. I to V comprises the support for the back of the hand and fingers, the wide irregularly shaped pointing finger extension 1 as shown in (FIGS. Ia, Ib, IIa, IIb, IIIa) is bend foward at an angle of about (10 degrees) and the side view is bend with a width of one fourth from each side view of the extension thus forming an arc from one side to another, a stiffener 2 was embose to add strength to the finger extension as shown in (FIG. IIa) is extended from the hand back up portion P1; the middle and ring finger extension 16 is extended from the hand back up portion P1 with a length of 1½ inches and with a width of 2 inches, the 16 is tilted to the right for about 13 degrees from a 90 degree vertical point of view as shown in (FIG. IVa); the wide irregularly shaped pointing finger with the middle and ring finger extension 13 as shown in (FIG. Va) has the same combined descriptions as defined in 1 and 16; the wide irregularly shaped small finger support extension 14 is extended from the hand back up portion P1 and the said extension is tilted to the right at about (13 degrees) from a 90 degree vertical point of view and it was extended by about 1½ inches and a width of 1 inch at the end of the extension as shown in (FIG. Vb), a stiffener 15 was embose to add strength to the finger support as shown in the same figure. A rubberized foam padding 3 is in use to cushion the back of the fingers, hand, wrist and forearm, it was attached to the inner side of the hand back up portion P1 and all its finger extensions and the forearm back up portion P3 as illustrated in all the models. A hole 5 as shown in all the models stated is located at the center of the hand back up portion P1 to serve as ventilation to the back of the hand while the prior invention is in use. A leather strap 6 is use to strap the P1 to the back of the hand as shown in (FIG. IIIa) and 4 as shown in (FIG. 1*a*) is the location of the Velcro to be use as securing device after it was strapped to the hand and back again to the top outer side of P1, the leather strap is attached to the top outer side of the P1 as shown in all the models. The contact tip end 23 is located at the end of P1 as shown in (FIG. IIa) is also true to all the models, serves as the contact point as it touches the stopping lock 19 thus creating a limited or restricted angle of the plane of P1 from the plane of the P2 and P3. In (FIG. IIb and IIIa) 7 is the pivotal connection of P1 and P2 wherein P1 can move in an indefinite vertical foward and backward motion and it cannot be hold to a position permanently at the point of release because of the foward follow through movement of the hand.

The wing type part P2, has an approximate width of ¾ inch at the general area of the middle and both the wing end part is tapered from the middle as shown in (FIG. Ia), the height of P2 has two folds, the first fold starts with ½ inch and the second is ⅝ inch from the first fold and it has a thickness of ⅛ of an inch and a length of 4 inches as shown in the back view of (FIG. IIc). The wing type part P2 as shown in (FIG. Ia) and is true to all the models is connected to P1 by 7 and attached on the top front end of P3. In (FIG. Ib), P2 is pivotally attached to P3, wherein P2 while P1 is connected and can pivot and move in the vertical plane, can be pivotally moving indefinitely sideways of the horizontal plane at the point of attachment 11 of P3. An arc form slot 9 which is an integral part of P2 to serve as a securing or holding position of P2 to P3, as P2 moves sideways of the horizontal plane, the swivel lock 12 is vertically located inside the arc form slot of P2 is connected to P3, it can be turned clockwise or counterclockwise to hold or release the intended position of P2 as shown in (FIGS. Ia and Ib).

The adjustable stopping mechanism P4 as shown in (FIG. IIIb) with its measurement and also with all the models has the guiding rod 20, adjustable screw 18, shaft 21, stopping lock 19 and casing 17. The clockwise movement of 18 will allow the foward movement of 19 and counterclockwise will produce a backward motion. The 19 is connected to 21 which is a screw type shaft passes through 19 so that 19 can travel foward and backward, a 20 is used, that also passes through 19 and to guide 19 from its movement and it also prevents the 19 from turning over when an action is induced on 18. When a turning action is made on 18 an appropriate movement of P1 will take effect if 23 is touching the 19 as shown in (FIG. IIa and IIb), thus a limited or restricted angle will be produced and when P1 moves a unrestricted and greater angle will take into effect from the perpendicular plane of P3. The P4 is permanently attached to the top middle area of P2, using 22 as the permanent attachment point as shown in (FIG. Ib). All of the above stated action and descriptions as defined in true for all the models of the invention.

The forearm back up portion P3 as shown in all the models is connected to P2 at 11 as shown in (FIG. Ib). A 3 is also used on P3 to cushion the back of the forearm. A strap 8 is connected on one side of P3 as shown in the same fig. and is wrapped and strapped around the wrist forearm area and was slipped inside and out from the strap holder 10 from which it is hooked on the opposite side of where the strap was connected, then an applied pull motion of the strap is directed away from 10, will firmly position the forearm back up portion to the top of the forearm as shown in (FIG. IIIa). A Velcro is agained use to secure and hold the strap in position. A ventilation 5 with a diameter of 1 inch is placed at the back end part of P3. All of the above stated action and descriptions as defined is true for all the models of the prior invention.

We claim:

1. A moveable bowling wrist support device that prevents the hand from adjustably limiting the breaking backward motion while still allowing for free unlimited motion in a foward direction comprising:

a substantially planar hand back up portion element P1 having a means for attaching it to a back of a hand of a user, a substantially planar arm portion element P3 having a means for attaching to the back of a wrist in a location of a direction of the arm of a user, a substantially planar element P2 having a wing type structure and having a means for attaching P1 to P3, a first means for movably connecting P2 to P3, for movement about a perpendicular axis on a same plane wherein P2 is pivotally connected on top of a front end part which is located within the wrist area such that they can pivot indefinitely sideways with respect to each other and a second means for pivotally connecting P1 to P2 about a coplanar axis having P3 on the same plane of P2 such that P1 can pivot indefinitely in a foward and backward motion with respect to each other, said second means having a stopping mechanism P4 connected permanently on top of P2 with an adjusting means for adjustably limiting the breaking backward motion of P1 while still allowing for free unlimited motion in a foward direction, said second means having a stopping mechanism P4 comprising an adjustable screw, a guiding rod and a stopping lock wherein if the adjustable screw is turn, the stopping lock moves and is guided by the guiding rod, said second means having a stopping mechanism P4 that has a stopping lock that serves as an impact or stopping point of P1 as it moves on a backward motion in a direction of the stopping mechanism, said second means having a stopping mechanism P4 which has a guiding rod that prevents the stopping lock from turning when the adjustable screw is turned.

2. A movable bowling wrist support device as recited in claim 1 wherein the first means for movably connecting P2 to P3 further includes a locking means for securing P2 from moving or pivoting with respect to P3.

3. A movable bowling wrist support device as recited in claim 2 wherein the locking means is swivel lock whereby when turned P2 is secured from moving.

4. A movable bowling wrist support device as recited in claim 1 wherein P2 has a hand back up support portion P1 to extend over that back of the hand up to the knuckles of a user and a second portion to extend over the index finger of a user wherein the said second portion has an irregularly wide shape to help the user achieve an additional push to the ball because a wider contact point was established as it touches form each other, wherein the said second portion is bend over downward with an angle of about ten degrees with respect to the plane of P1.

5. A movable bowling wrist support device as recited in claim 1 wherein P2 has a hand back up support portion P1 to extend over that back of the hand up to the knuckles of a user and a second portion to extend over the middle and ring finger wherein the said second portion is extended at an angle about 30 deg. from a vertical point of view and with an ending width of about two inches.

6. A movable bowling wrist support device as recited in claim 1 wherein P2 has a hand back up support portion P1 to extend over that back of the hand up to the knuckles of a user and a second portion to extend over the index finger and another second portion to extend over the middle and ring finger, wherein the said first second portion has an irregularly wide shape to help the user achieve an additional push to the ball because a wider contact point was established as it touches from each other, and the said first second portion is bend over downwards with an angle of about ten degrees with respect to the plane of P1, wherein the another second portion is extended at an angle for about thirty degrees from a vertical point of view and with an ending width of about two inches.

7. A movable bowling wrist support device as recited in claim 1 wherein P2 has a hand back up support portion P1 to extend over that back of the hand up to the knuckles of a user and a second portion to extend over the small finger, wherein the said second portion has an irregularly wide shape and is extended at an angle for about thirteen degrees with an ending width of one inch.

8. A movable bowling wrist support device as recited in claim 1 wherein P2 has a hand back up support portion P1 to extend over that back of the hand up to the knuckles of a user.

* * * * *